US005397083A

United States Patent [19]

Thomas

[11] Patent Number: 5,397,083

[45] Date of Patent: Mar. 14, 1995

[54] RAIL GUARD

[76] Inventor: Donald Thomas, 117 W. Elm, Marion, Ky. 42064

[21] Appl. No.: 239,564

[22] Filed: May 9, 1994

[51] Int. Cl.[6] ..... B61L 23/04

[52] U.S. Cl. ..... 246/121; 33/651; 33/523.1; 200/573

[58] Field of Search ..... 33/287, 783, 806, 523.1, 33/523.2, 624, 651, 651.1, 338; 200/573, 574, 337, 338, 61.42; 246/120, 121

[56] References Cited

U.S. PATENT DOCUMENTS 857,436 6/1907 Bond ..... 246/120
1,383,093 6/1921 Finch ..... 246/121
2,175,655 10/1939 Allen ..... 33/651.1
3,839,607 10/1974 Ogihara ..... 200/337 X
4,008,870 2/1977 Gardner et al. ..... 246/120

*Primary Examiner*—Alvin Wirthlin

[57] ABSTRACT

A rail guard for monitoring the limits of transverse inclination and extension between the rails of a railroad track and transmitting an indication when these limits are breached. The rail guard has a plurality of tension switches, each switch being coupled between the outer edge of a railroad track and a penetrable surface near the railroad track. The tension switches are coupled in series and in turn are coupled to a relay. The relay controls a warning signal when one or more of the switches is in an open position.

5 Claims, 3 Drawing Sheets

RAIL GUARD

BACKGROUND OF THE INVENTION

1. Field of the Invention

The present invention relates to a rail guard and more particularly pertains to monitoring the limits of transverse inclination and extension between a pair of rails of a railroad track and transmitting an indication signal when these limits are breached with a rail guard.

2. Description of the Prior Art

The use of railroad track measurement devices is known in the prior art. More specifically, railroad track measurement devices heretofore devised and utilized for the purpose of monitoring the status of railroad tracks are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,775,859 to Sauterel discloses a method and apparatus for measuring the inclination of a railway track. U.S. Pat. No. 3,835,546 to Jaquet discloses a measuring device for checking and/or correcting the transverse slope of railway tracks. U.S. Pat. No. 3,869,805 to Dieringer discloses a track level indicator. U.S. Pat. No. 4,673,854 to Patton et al. discloses an electronic cross-level detection system. U.S. Pat. No. 5,036,594 to Kesler et al. discloses a method and apparatus for gauging the crosslevel and warp of railroad tracks.

While these devices fulfill their respective, particular objective and requirements, the aforementioned patents do not describe a rail guard that monitors the limits of transverse inclination and extension between the rails of a railroad track and transmits an indication signal when these limits are breached.

In this respect, the rail guard according to the present invention substantially departs from the conventional concepts and designs of the prior art, and in doing so provides an apparatus primarily developed for the purpose of monitoring the limits of transverse inclination and extension between a pair of rails of a railroad track and transmitting an indication signal when these limits are breached.

Therefore, it can be appreciated that there exists a continuing need for new and improved rail guard which can be used for monitoring the limits of transverse inclination and extension between a pair of rails of a railroad track and transmitting an indication signal when these limits are breached. In this regard, the present invention substantially fulfills this need.

SUMMARY OF THE INVENTION

In the view of the foregoing disadvantages inherent in the known types of railroad track measurement devices now present in the prior art, the present invention provides an improved rail guard. As such, the general purpose of the present invention, which will be described subsequently in greater detail, is to provide a new and improved rail guard and method which has all the advantages of the prior art and none of the disadvantages.

To attain this, the present invention essentially comprises, in combination, a pair of elongated tension switches coupled in series with each tension switch adapted to be placed on opposed sides of a railroad track in contact with the outer edge of each rail. Each tension switch includes a U-shaped rail clamp having two opposed and laterally extended side legs with a cross leg coupled therebetween and a space defined between the opposed side legs, the space adapted to hold an outer edge of a rail therein, the rail clamp further having a bolt disposed through one of the side legs and extended in the space, the bolt adapted to be secured to the outer edge of a rail. Each tension switch includes a hollow, tubular, and laterally extended housing having a base end, an opened end, a side wall extended therearound, and a bushing threadably coupled to the opened end. Each tension switch includes a lateral extension arm having a first end, a threaded second end, and an intermediate portion therebetween, the first end coupled to the cross leg of the rail clamp with the intermediate portion slidably extended through the bushing of the housing and terminated within the housing at the second end. Each tension switch includes an elongated cam lobe having one end coupled to the second end of the extension arm and a free end axially extended therefrom, the cam lobe further having a downwardly extended edge formed thereon located adjacent to the free end and a downwardly extended notch formed thereon located between the extended edge and the second end of the extension arm.

Each tension switch includes a first adjustment mechanism for adjusting the lateral extent of the arm from the housing, the first adjustment mechanism having a washer disposed about the intermediate portion of the arm, a spring disposed between the washer and bushing for maintaining the lateral extent of the extension arm from the housing, and a nut threadably disposed between the washer and the cam lobe for adjusting the extent of the extension arm and the tension on the spring. Each tension switch includes an anchor rod having a head at one end and a point on the other end, the point adapted to be secured in a penetrable surface near the outer edge of a railroad track, the head further having a threaded hole disposed thereon. Each tension switch includes a second adjustment mechanism coupled between the anchor rod and the housing for adjusting the lateral extent of the housing from the anchor rod, the second adjustment mechanism having a first extender bolt with a threaded portion at one end and an eyelet at the other end, a second extender bolt with the head at one end and a threaded portion at the other end, and a turnbuckle threadably coupled between the threaded portions for allowing adjustment of the lateral extent of the bolts from each other, the eyelet of the first extender bolt and the threaded hole of the anchor rod are coupled together with an anchor bolt and the head of the second extender bolt extended through and pivotally coupled with the base end of the housing.

Each tension switch includes an elongated toggle switch extended through the side wall of the housing and coupled therewith, the toggle switch having closed position for allowing communication therethrough and an opened position for preventing communication therethrough. Lastly, each tension switch includes a switch lever coupled within the housing and extended between the toggle switch and the cam lobe, the switch lever having a first orientation for indicating that the limits have not been breached when the switch lever is positioned in contact with the extended edge of the cam lobe and the toggle switch is in a closed position and a second orientation for indicating that the limits have been breached when the switch lever is not positioned in contact with the extended edge of the cam lobe and the toggle switch is in an open position.

A radio transmitter is included and has an active state and an inactive state with the active state adapted for allowing the transmission of an indication signal to a remote site when the toggle switch is placed in the open position and the inactive state adapted for preventing the transmission of an indication signal. A warning light is included and is connected in parallel with the radio transmitter and adapted to be placed near a railroad track, the warning light further having an active state and an inactive state with the active state adapted for transmitting an audible and visual indication signal when the toggle switch is placed in the open position and the inactive state adapted for preventing the transmission of an indication signal.

Relay means are included and coupled between the series connection of the tension switches and the parallel connection of the transmitter and warning light, the relay means having one mode for placing the transmitter and warning light in the active state when either of the toggle switches are placed in an open orientation and another mode for placing the transmitter and warning light in the inactive state when both toggle switches are placed in a closed orientation. An electrical power source is included for energizing and de-energizing the series connection of tension switches, the parallel connection of the transmitter and warning light, and the relay means. Lastly, electrical power lines are included and coupled between the power source, the series connection of tension switches, the parallel connection of the transmitter and warning light, and the relay means.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved rail guard which has all the advantages of the prior art railroad track measurement devices and none of the disadvantages.

It is another object of the present invention to provide a new and improved rail guard which may be easily and efficiently manufactured and marketed.

It is a further object of the present invention to provide a new and improved rail guard which is of durable and reliable construction.

An even further object of the present invention is to provide a new and improved rail guard which is susceptible of a low cost of manufacture with regard to both materials and labor, and which accordingly is then susceptible of low prices of sale to the consuming public, thereby making such a rail guard economically available to the buying public.

Still yet another object of the present invention is to provide a new and improved rail guard which provides in the apparatuses and methods of the prior art some of the advantages thereof, while simultaneously overcoming some of the disadvantages normally associated therewith.

Even still another object of the present invention is to provide a new and improved rail guard for monitoring the limits of transverse inclination and extension between a pair of rails of a railroad track and transmitting an indication signal when these limits are breached.

Lastly, it is an object of the present invention to provide a new and improved rail guard comprising a plurality of tension switches, each tension switch adapted to be placed on a side of a railroad track in contact with an outer edge of each rail, each tension switch further comprising a rail clamp adapted to hold an outer edge of a rail therein; a hollow housing having a base end, an opened end, and a side wall generally extended therearound; a lateral extension arm having a first end, a second end, and an intermediate portion therebetween, the first end coupled to the rail clamp with the intermediate portion extended through the opened end of the housing and terminated within the housing at the second end; an elongated cam lobe having one end coupled to the second end of the extension arm and a free end axially extended therefrom, the cam lobe further having a downwardly extended edge formed thereon located adjacent to the free end and a downwardly extended notch formed thereon located between the extended edge and the second end of the extension arm; coupling means for coupling the base end of the housing near the outer edge of a railroad track; a toggle switch extended within the housing, the toggle switch having a closed position for allowing communication therethrough and an opened position for preventing communication therethrough; and a switch lever extended between the toggle switch and the cam lobe, the switch lever having a first orientation for indicating that the limits have not been breached when the switch lever is positioned in contact with the extended edge of the cam lobe and the toggle switch is in a closed position and a second orientation for indicating that the limits have been breached when the switch lever is not positioned in contact with the extended edge of the cam lobe and the toggle switch is in an open position; indication means having an active state and an inactive state with the active state adapted for transmitting an indication signal to a remote site when the toggle switch is placed in the open position; relay means coupled between the tension switches and indication means, the relay means having one mode for placing the indication means in the active state when a toggle switch is placed in an open orientation and another mode for placing the indication means in the inactive state when the toggle switches are placed in a closed orientation; and a power source for energizing and de-energizing the tension switches and indication means.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
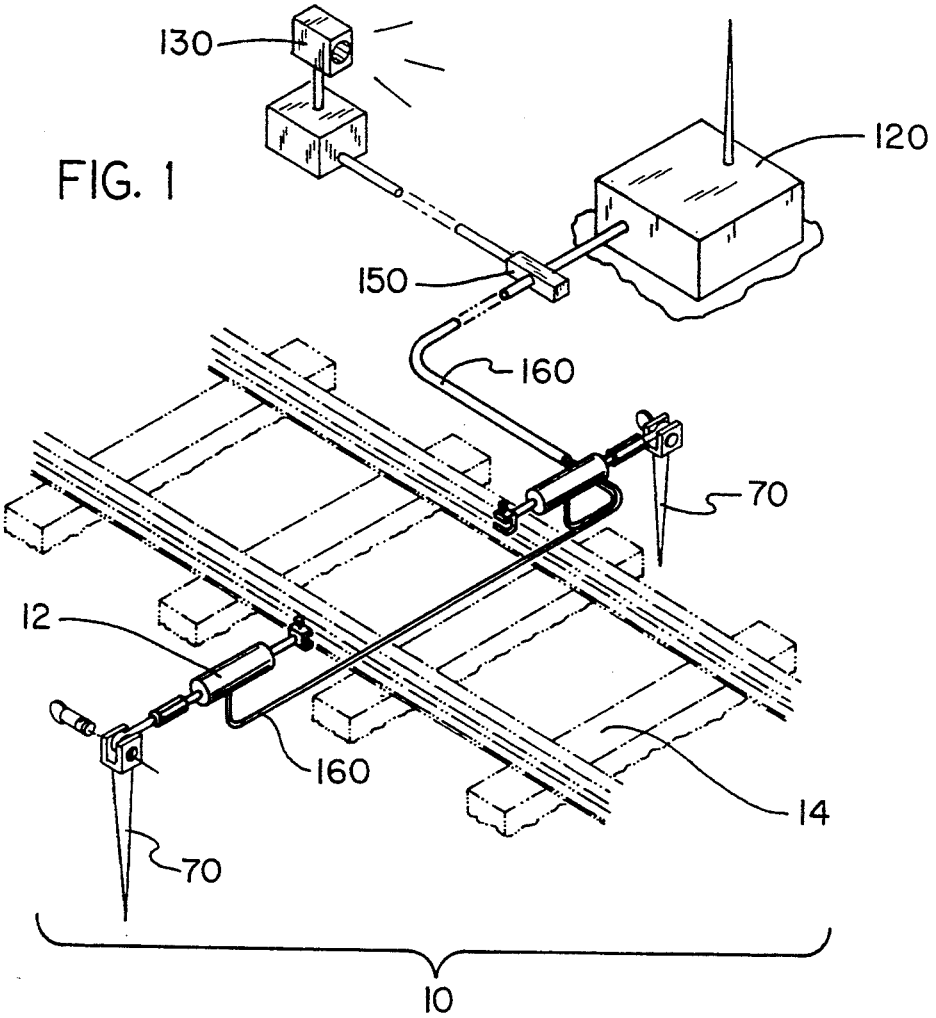
FIG. 1 is a perspective view of the preferred embodiment of the rail guard constructed in accordance with the principles of the present invention.
Figure 2:
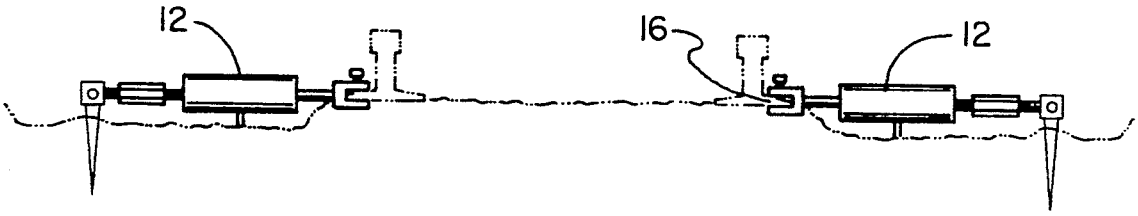
FIG. 2 is a side elevational view of the present invention depicted in FIG. 1.

With reference now to the drawings, and in particular, to FIG. 1 thereof, the preferred embodiment of the new and improved rail guard embodying the principles and concepts of the present invention and generally designated by the reference number 10 will be described.

Specifically, the present invention includes 6 major components. The major components are the tension switches, radio transmitter, warning light, relay means, electrical power source, and electrical power lines. These components are interrelated to provide the intended function.

More specifically, it will be noted in the various Figures that the first major component is the tension switches 12. The present invention includes a pair of tension switches coupled in series. Each tension switch is elongated in structure. Each tension switch is adapted to be placed on opposed sides of a railroad track 14 in contact with the outer edge of each rail 16. Each tension switch includes 9 subcomponents. The subcomponents are the rail clamp, housing, extension arm, cam lobe, first adjustment mechanism, anchor rod, second adjustment mechanism, toggle switch, and switch lever. These subcomponents are interrelated to provide the intended function.

Figure 3:
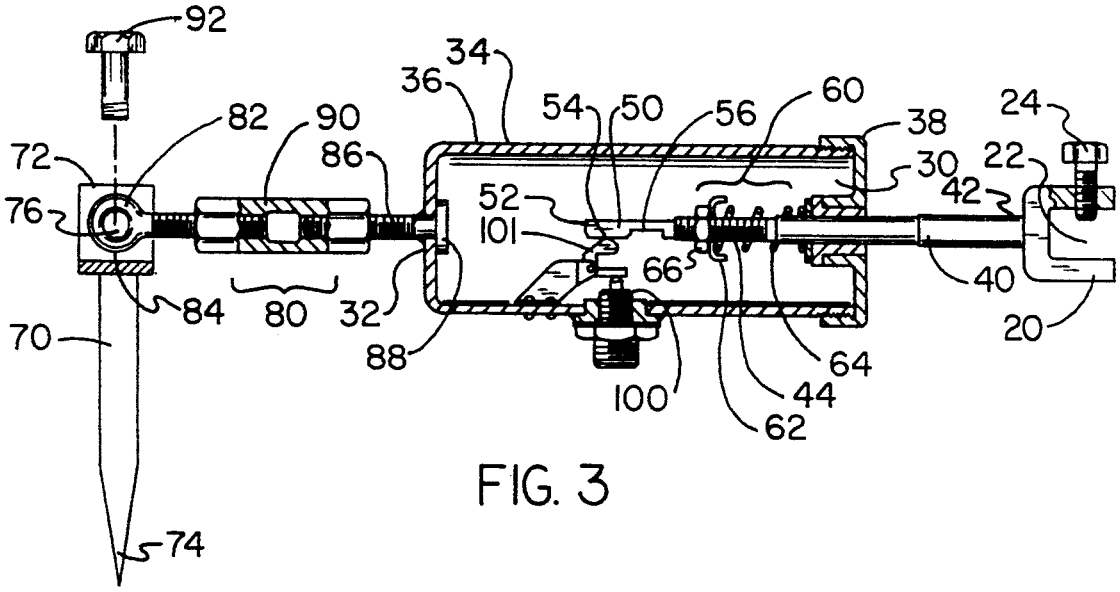
FIG. 3 is a cross-sectional view of one of the tension switches of the present invention.

The first subcomponent of the tension switch is a rail clamp 20 (see FIG. 3). The rail clamp is U-shaped and rigid in structure. The rail clamp has two opposed and laterally extended side legs. A cross leg is coupled between the side legs to define a space 22 between the opposed side legs. The space is adapted to hold an outer edge of a rail 16 therein. The rail clamp further includes a bolt 24 disposed through one of the side legs. The bolt is extended into the space and adapted to be secured to the outer edge of the rail.

The second subcomponent of the tension switch is a housing 30. The housing is hollow and tubular in structure. The housing is configured in a lateral position. The housing has a base end 32, an opened end 34, and a side wall 36 extended therearound. The housing also includes a bushing 38. The bushing is threadably coupled to the opened end.

The third subcomponent of the tension switch is the extension arm 40. The extension arm is laterally positioned. It has a first end 42, a threaded second end 44, and an intermediate portion therebetween. The first end of the extension arm is coupled to the cross leg of the rail clamp 20. The intermediate portion of the extension arm is slidably extended through the bushing 38 of the housing. The extension arm is terminated at the second end within the housing.

The fourth subcomponent of the tension switch is the cam lobe 50. The cam lobe is elongated in structure. It has one end coupled to the second end of the extension arm 40 and a free end 52 axially extended therefrom. The cam lobe further includes a downwardly extended edge 54 formed thereon and located adjacent to the free end. The cam lobe also includes a downwardly extended notch 56 formed thereon and located between the extended edge and the second end 44 of the extension arm.

The fifth subcomponent of the tension switch is the first adjustment mechanism 60. The first adjustment mechanism is used for adjusting the lateral extent of the extension arm from the housing 30. The first adjustment mechanism has a washer 62 disposed about the intermediate portion of the extension arm. The first adjustment mechanism also includes a spring 64 disposed between the washer and bushing 38. The spring is used for maintaining the lateral extent of the extension arm from the housing. Lastly, the first adjustment mechanism includes a nut 66 threadably disposed between the washer and the cam lobe 50. The nut is used for adjusting the extent of the extension arm and the tension on the spring.

The sixth subcomponent of the tension switch is the anchor rod 70. The anchor rod has a head 72 at one end and a point 74 on the other end. The point on the anchor rod is adapted to be secured in a penetrable surface such as gravel or dirt near the outer edge of a railroad track. The head of the anchor rod further includes a threaded hole 76 disposed thereon. The anchor rod can be drilled into the ground or into concrete such as a bridge pier to obtain a fixed anchor position.

The seventh subcomponent of the tension switch is the second adjustment mechanism 80. The second adjustment mechanism is coupled between the anchor rod 70 and the housing 30. The second adjustment mechanism is used for adjusting the lateral extent of the housing from the anchor rod. The second adjustment mechanism has a first extender bolt 82 with a threaded portion at one end and an eyelet 84 at the other end. The second adjustment mechanism also has a second extender bolt 86 with a head 88 at one end and a threaded portion at the other end. A turnbuckle 90 is threadably coupled between the threaded portions of the first extender bolt and second extender bolt. The turnbuckle allows adjustment of the lateral extent of the bolts from each other. The eyelet of the first extender bolt and the threaded hole 76 of the anchor rod are coupled together with an anchor bolt 92. The head of the second extender bolt is extended through and pivotally coupled with the base end 32 of the housing.

The eighth subcomponent of the tension switch is a toggle switch 100. The toggle switch is elongated in structure. The toggle switch extends through the side wall 36 of the housing and is coupled therewith. The toggle switch has a closed position for allowing communication therethrough and an open position for preventing communication therethrough.

The ninth subcomponent of the tension switch is the switch lever 101. The switch lever is coupled within the housing. The switch lever is also extended between the toggle switch 100 and the cam lobe 50. The switch lever has a first orientation for indicating that the limits of transverse inclination and extension between the rails of a railroad track have not been breached when the switch lever is positioned in contact with the extended edge 54 of the cam lobe and the toggle switch is in a closed position. The switch lever has a second orientation for indicating that the limits of transverse inclination and extension between the rails of a railroad track have been breached when the lever is not positioned in contact with the extended edge of the cam lobe and the toggle switch is in an opened position.

Figure 4:
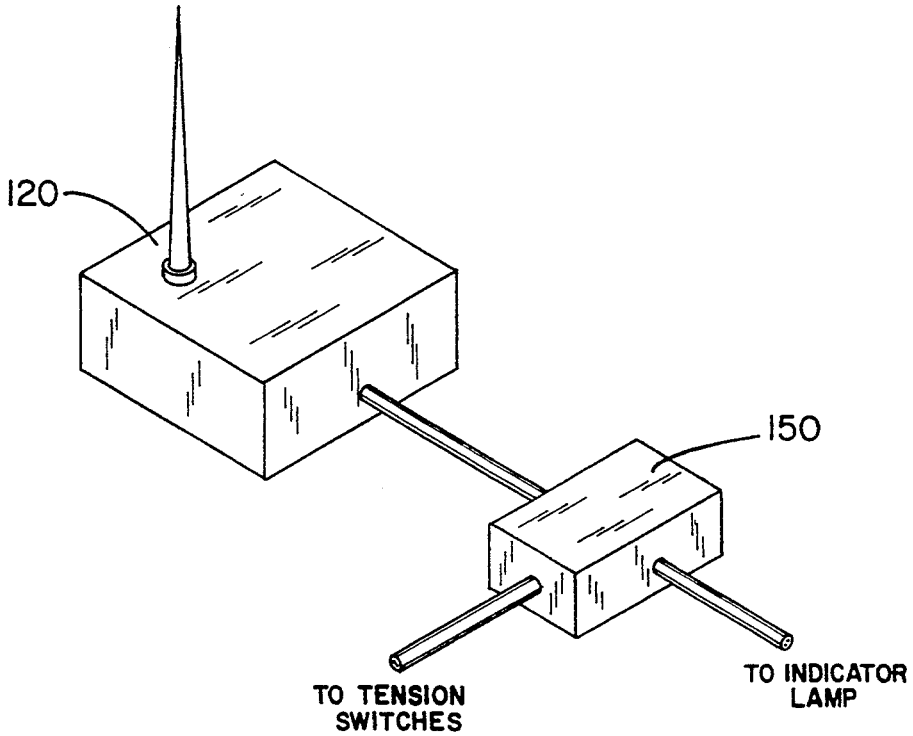
FIG. 4 is a perspective view of the transmitter and power source of the present invention.
Figure 5:
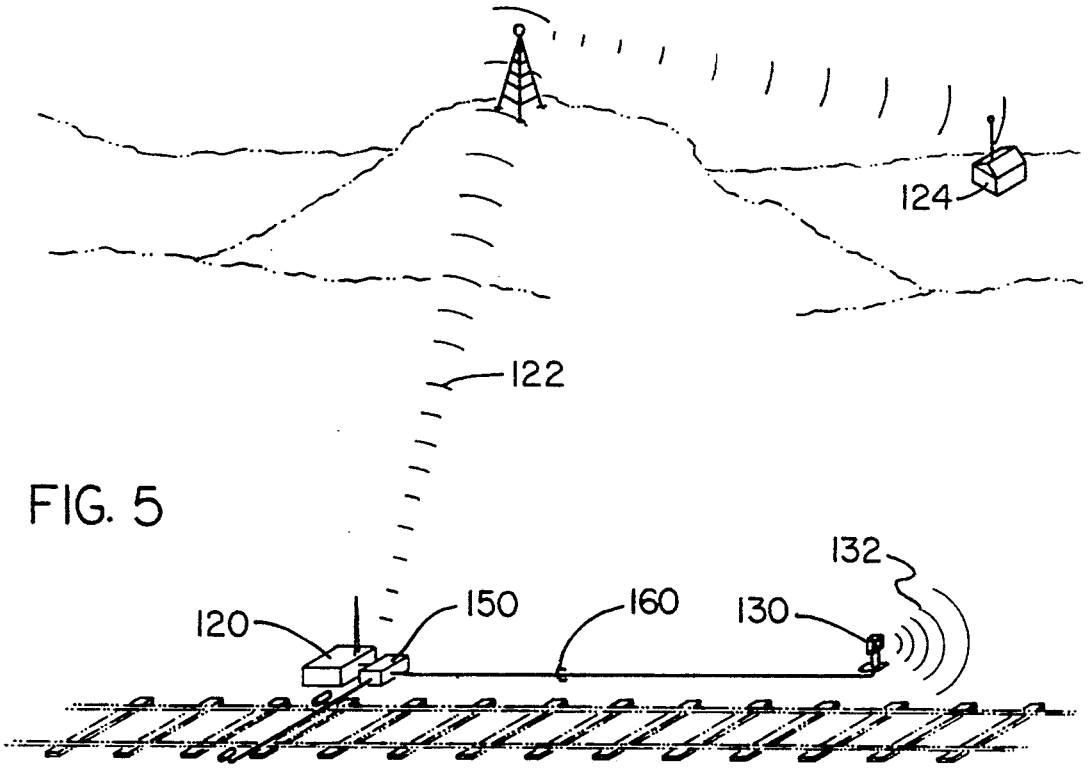
FIG. 5 is a perspective view of the present invention in operation and transmitting a signal to a remote base indicating that the limits of transverse inclination and extension between the rails of a railroad track have been exceeded.

The second major component is the radio transmitter 120 (see FIGS. 4 and 5). The radio transmitter has an active state and an inactive state. The active state is adapted for allowing the transmission of an indication signal 122 to a remote site 124. The inactive state is adapted for preventing the transmission of an indication signal. The radio transmitter is preferably placed a short distance from the railroad track to ensure that it will not be destroyed in the event of a serious derailment.

The third major component is the warning light 130. The warning light is connected in parallel with the radio transmitter 120. The warning light is adapted to be placed near a railroad track 14. The warning light has an active state and an inactive state. The active state is adapted for transmitting an audible and visual indication signal 132. The inactive state is adapted for preventing the transmission of an indication signal.

Figure 6:
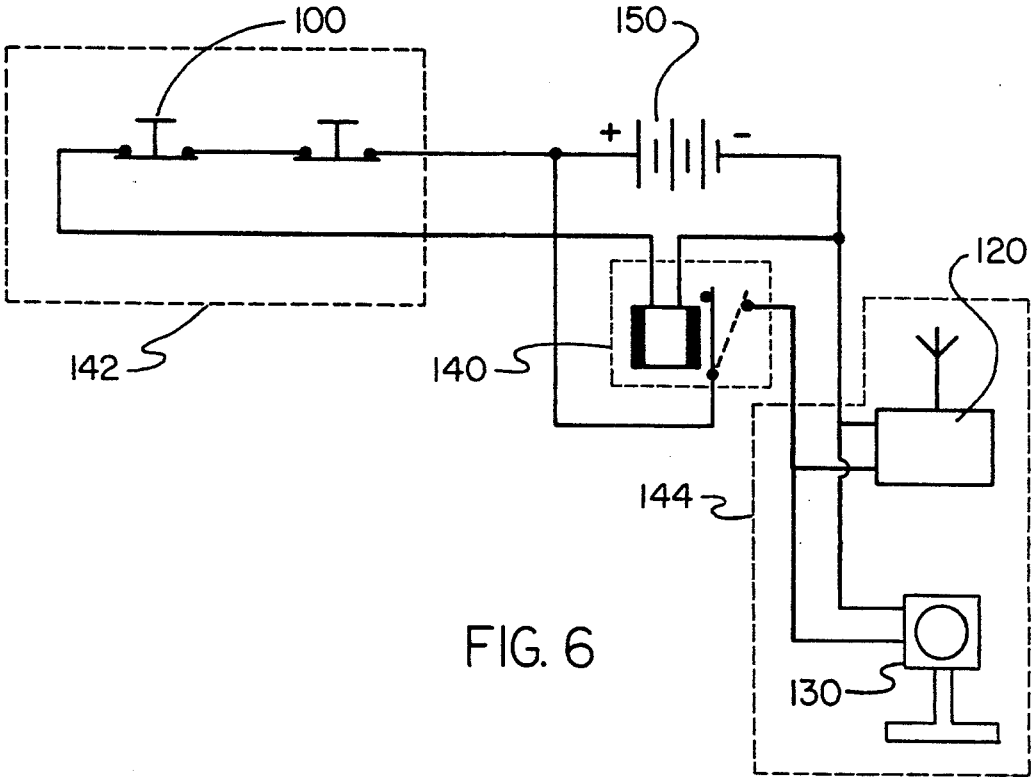
FIG. 6 is a schematic diagram of the present invention depicting the tension switches connected in series, the transmitter and warning light connected in parallel, and the power source and relay means coupled therebetween.

The fourth major component is the relay means 140 (see FIG. 6). The relay means is coupled between the series connection of the tension switches 142 and the parallel connection of the transmitter and warning light 144. The relay means has one mode for placing the transmitter and warning light in the active state when either of the toggle switches are placed in an open orientation. The relay means has another mode for placing the transmitter and warning light in the inactive state when both toggle switches are placed in a closed orientation.

The fifth major component is the electrical power source 150. The electrical power source is used for energizing and de-energizing the series connection of tension switches 142, the parallel connection of the transmitter and warning light 144, and the relay means 140. The electrical power source is placed at a location offset from the railroad track.

The sixth major component is the electrical power lines 160. The electrical power lines are coupled between the power source 150, the series connection of tension switches 142, the parallel connection of the transmitter and warning light 144, and the relay means 140. The electrical power lines are adapted to carry power from the electrical power source to the aforementioned components.

In the preferred embodiment, the present invention is used to monitor the condition of railroad tracks located on the ground, on bridges, in a tunnel, or other potentially hazardous areas. The present invention is designed to warn the engineer in advance of track damage that could possibly be life threatening to the passengers and crew. For example if a river tow boat happened to strike a bridge support, or an earthquake should move the supporting railway structure far enough to buckle or break the track, this disruption of track integrity would be detected by the tension switches and would activate the warning device.

Due to the simplicity of this system simply making or breaking an electrical circuit, several different warning systems could be used. In the preferred embodiment, a warning would be activated by a transmitter and a warning light. In an alternate embodiment, either the transmitter or the warning light could be used. Furthermore, in alternate embodiments it makes no difference how many tension switches are used as long as they are in series.

The present invention could also be used in remote areas to give warning automatically that an accident has occurred so that rescue personnel could be notified. For example the present invention could be placed in remote areas where there are sharp curves or other possible hazardous areas of track. In the event a serious derailment should occur in an area that was being monitored, the track would more than likely be damaged, which would send an automatic warning signal to the proper authorities.

The toggle switch will open the electric circuit if the rail clamp is extended to the point where the switch lever will drop off the end, or has been compressed to the point that the switch lever will drop into the clamp bar notch. As long as the switch lever remains on the cam lobe, the circuit will stay closed. The tension pressure on the rail clamp can be adjusted through the adjustment nut and turn buckle. The present invention includes adjustment means for fine tuning the sensitivity.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A rail guard for monitoring the limits of transverse inclination and extension between the rails of a railroad track and transmitting an indication signal when these limits are breached comprising, in combination:

a pair of elongated tension switches coupled in series, each tension switch adapted to be placed on opposed sides of a railroad track in contact with the outer edge of each rail, each tension switch further comprising:

a U-shaped rail clamp having two opposed and laterally extended side legs with a cross leg coupled therebetween and a space defined between the opposed side legs, the space adapted to hold an outer edge of a rail therein, the rail clamp further having a bolt disposed through one of the side legs and extended in the space, the bolt adapted to be secured to the outer edge of a rail;

a hollow, tubular, and laterally extended housing having a base end, an opened end, a side wall extended therearound, and a bushing threadably coupled to the opened end;

a lateral extension arm having a first end, a threaded second end, and an intermediate portion therebetween, the first end coupled to the cross leg of the rail clamp with the intermediate portion slidably extended through the bushing of the housing and terminated within the housing at the second end;

an elongated cam lobe having one end coupled to the second end of the extension arm and a free end axially extended therefrom, the cam lobe further having a downwardly extended edge formed thereon located adjacent to the free end and a downwardly extended notch formed thereon located between the extended edge and the second end of the extension arm;

a first adjustment mechanism for adjusting the lateral extent of the arm from the housing, the first adjustment mechanism having a washer disposed about the intermediate portion of the arm, a spring disposed between the washer and bushing for maintaining the lateral extent of the extension arm from the housing, and a nut threadably disposed between the washer and the cam lobe for adjusting the extent of the extension arm and the tension on the spring;

an anchor rod having a head at one end and a point on the other end, the point adapted to be secured in a penetrable surface near the outer edge of a railroad track, the head further having a threaded hole disposed thereon;

a second adjustment mechanism coupled between the anchor rod and the housing for adjusting the lateral extent of the housing from the anchor rod, the second adjustment mechanism having a first extender bolt with a threaded portion at one end and an eyelet at the other end, a second extender bolt with a head at one end and a threaded portion at the other end, and a turnbuckle threadably coupled between the threaded portions for allowing adjustment of the lateral extent of the bolts from each other, the eyelet of the first extender bolt and the threaded hole of the anchor rod are coupled together with an anchor bolt, and the head of the second extender bolt extended through and pivotally coupled with the base end of the housing;

an elongated toggle switch extended through the side wall of the housing and coupled therewith, the toggle switch having closed position for allowing communication therethrough and an opened position for preventing communication therethrough;

a switch lever coupled within the housing and extended between the switch and the cam lobe, the switch lever having a first orientation for indicating that the limits have not been breached when the switch lever is positioned in contact with the extended edge of the cam lobe and the toggle switch is in a closed position and a second orientation for indicating that the limits have been breached when the switch lever is not positioned in contact with the extended edge of the cam lobe and the toggle switch is in an open position; and a radio transmitter having an active state and an inactive state with the active state adapted for allowing the transmission of an indication signal to a remote site and the inactive state adapted for preventing the transmission of the indication signal;

a warning light connected in parallel with the radio transmitter and adapted to be placed near a railroad track, the warning light further having an active state and an inactive state with the active state adapted for transmitting an audible and visual indication signal and the inactive state adapted for preventing the transmission of the audible and visual indication signal;

relay means coupled between the series connection of the tension switches add the parallel connection of the transmitter and warning light, the relay means having one mode for placing the transmitter and warning light in the active state when either of the toggle switches are placed in the open position and another mode for placing the transmitter and warning light in the inactive state when both toggle switches are placed in the closed position;

an electrical power source for energizing and de-energizing the series connection of tension switches, the parallel connection of the transmitter and warning light, and the relay means; and electrical power lines coupled between the power source, the series connection of tension switches, the parallel connection of the transmitter and warning light, and the relay means.

2. A rail guard for monitoring the limits of transverse inclination and extension between the rails of a railroad track and transmitting an indication signal when these limits are breached comprising, in combination:

a plurality of tension switches, each tension switch adapted to be placed on a side of a railroad track in contact with an outer edge of each rail, each tension switch further comprising:

a rail clamp adapted to hold a rail therein; a hollow housing having a base end, an opened end, and a side wall generally extended therearound;

a lateral extension arm having a first end, a second end, and an intermediate portion therebetween, the first end coupled to the rail clamp with the intermediate portion extended through the opened end of the housing and terminated within the housing at the second end;

an elongated cam lobe having one end coupled to the second end of the extension arm and a free end axially extended therefrom, the cam lobe further having an edge formed thereon located adjacent to the free end and a extended notch formed thereon located between the extended edge and the second end of the extension arm;

coupling means for coupling the base end of the housing near the outer edge of a railroad track;

a toggle switch extended within the housing, the toggle switch having a closed position for allowing communication therethrough and an opened position for preventing communication therethrough; and a switch lever extended between the toggle switch and the cam lobe, the switch lever having a first orientation for indicating that the limits have not been breached when the switch lever is positioned in contact with the extended edge of the cam lobe and the toggle switch is in the closed position and a second orientation for indicating that the limits have been breached when the switch lever is not positioned in contact with the extended edge of the cam lobe and the toggle switch is in the open position;

indication means having an active state and an inactive state with the active state adapted for transmitting an indication signal to a remote site when at least one of the toggle switches is placed in the open position;

relay means coupled between the tension switches and indication means, the relay means having one mode for placing the indication means in the active state when at least one of the toggle switches is placed in an open orientation and another mode for placing the indication means in the inactive state when the toggle switches are placed in a closed orientation; and a power source for energizing and de-energizing the tension switches and indication means.

3. The device as set forth in claim 2 further including adjustable means coupled between the housing, coupling means, and extension arm for adjusting the distance between the coupling means and the rail clamp.

4. The device as set forth in claim 2 wherein the indication means is a radio transmitter.

5. The device as set forth in claim 2 wherein the indication means is a warning light.

* * * * *